US006491104B1

(12) United States Patent
Wilie et al.

(10) Patent No.: US 6,491,104 B1
(45) Date of Patent: Dec. 10, 2002

(54) OPEN-HOLE TEST METHOD AND APPARATUS FOR SUBTERRANEAN WELLS

(75) Inventors: Curtis L. Wilie, Alvin, TX (US); Jackie M. LaFontaine, Spring, TX (US); Tommy F. Grigsby, Houma, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/685,920

(22) Filed: Oct. 10, 2000

(51) Int. Cl.[7] ..... E21B 33/12; E21B 47/00
(52) U.S. Cl. ..... 166/336; 166/250.17
(58) Field of Search ..... 166/336, 250.16, 166/250.17, 387, 187, 191

(56) References Cited

U.S. PATENT DOCUMENTS

| | | | | | |
|---|---|---|---|---|---|
| 3,422,673 | A | | 1/1969 | Lebourg | |
| 3,459,264 | A | * | 8/1969 | Olson et al. | 166/250.17 |
| 4,787,477 | A | | 11/1988 | Dolan | |
| 4,856,585 | A | | 8/1989 | White et al. | |
| 4,860,580 | A | | 8/1989 | DuRocher | |
| 4,903,765 | A | | 2/1990 | Zunkel | |
| 4,936,139 | A | | 6/1990 | Zimmerman et al. | |
| 5,058,674 | A | | 10/1991 | Schultz et al. | |
| 5,105,881 | A | | 4/1992 | Thoms et al. | |
| 5,240,072 | A | | 8/1993 | Schultz et al. | |
| 5,249,461 | A | | 10/1993 | Ponder et al. | |
| 5,287,741 | A | | 2/1994 | Schultz et al. | |
| 5,329,811 | A | | 7/1994 | Schultz et al. | |
| 5,341,880 | A | * | 8/1994 | Thorstensen et al. | 166/278 |
| 5,353,875 | A | | 10/1994 | Schultz et al. | |
| 5,615,741 | A | | 4/1997 | Coronado | |
| 5,755,286 | A | * | 5/1998 | Ebinger | 166/281 |
| 5,826,662 | A | * | 10/1998 | Beck et al. | 166/387 |
| 5,934,376 | A | | 8/1999 | Nguyen et al. | |
| 6,003,600 | A | | 12/1999 | Nguyen et al. | |
| 6,318,465 | B1 | * | 11/2001 | Coon et al. | 166/278 |
| 2001/0050170 | A1 | * | 12/2001 | Woie et al. | 166/250.17 |

* cited by examiner

*Primary Examiner*—William Neuder
(74) *Attorney, Agent, or Firm*—William H. Imwalle; Peter V. Schroeder

(57) ABSTRACT

The invention comprises a tubing assembly for use in testing an unconsolidated open-hole portion of a well bore located below a cased portion of the well bore and a method of using the assembly. The tubing assembly comprises an elongated tubing string extending from a well surface into the unconsolidated open-hole portion of the open hole, an open-hole packer mounted on the tubing string for use in sealingly engaging the unconsolidated open-hole portion of the well bore, a casing packer mounted on the tubing string between the open-hole packer and the well surface for sealingly engaging the cased portion of the well bore and a sand control device connected to the tubing string below the openhole packer. The assembly may further comprise additional open-hole packers and sand control devices mounted on the tubing string. Segments of the tubing string may be retrievable. The assembly may have one or more tubing disconnects mounted to the tubing string to disconnect segments of the tubing assembly. The tubing string may further comprise a selective flow device for selectively controlling the flow of well fluids from the well bore into the tubing string.

39 Claims, 2 Drawing Sheets

OPEN-HOLE TEST METHOD AND APPARATUS FOR SUBTERRANEAN WELLS

FIELD OF INVENTION

The present invention relates to fluid flow testing in subterranean hydrocarbon wells. More particularly, the present invention relates to methods and apparatus for flow testing in open-hole wells in unconsolidated formations.

BACKGROUND

Whether at sea or on land, during testing and completion of hydrocarbon wells, it is often necessary to test or evaluate the production capabilities of a well. This is typically done by isolating a subsurface formation, or a portion thereof, which is to be tested and subsequently flowing a sample of well fluid up through a tubing string to the surface. Various well data, such as pressure and temperature, in both static and flow conditions, may be monitored to evaluate the long-term production characteristics of the formation.

In a consolidated formation, where the formation materials provide well bore integrity such that the risk of collapse of the well bore is low, it may not be necessary to case the well bore prior to performing a drill stem test. Consolidated formations are often formed of hard rock, such as dolomite or limestone. In a consolidated well, open-hole packers are set directly against the well bore walls to isolate the zone of interest. Subsequently, the well is flow tested in the tubing string. A drill stem test tubing string carries packers, tester valves, circulating valves and the like to control the flow of fluids through the tubing string.

In an unconsolidated formation the risk of collapse of the well bore is high. Such a formation is typically formed of sand, or sand-and-shale, materials. Typically, where an unconsolidated well bore collapses onto the tubing string, it is not possible to obtain good test data. Consequently, one commonly used well testing procedure in unconsolidated wells is to first cement a casing into the well bore, perforate the casing, and then to perform the testing adjacent to the zone of interest in the formation. Subsequently the well fluid is flowed through perforations in the casing.

Although fluid flow testing of cased wells provides good test data, it has the disadvantage that the well must first be cased before the test can be conducted. Setting casing is costly and time-consuming. In "throw-away" wells, which are drilled primarily only for verification purposes, it is particularly desired to eliminate or lower total well costs. Also, better reservoir data can be obtained immediately after the well is drilled, prior to casing the well and before the well bore is damaged by drilling fluids and the like. This has led to a number of attempts at developing a successful open-hole test which can be used in an unconsolidated bore hole.

SUMMARY

The invention comprises a tubing assembly for use in testing an unconsolidated open-hole portion of a well bore located below a cased portion of the well bore. The tubing assembly comprises an elongated tubing string extending from a well surface into the unconsolidated open-hole portion of the open hole, an open-hole packer mounted on the tubing string for use in sealingly engaging the unconsolidated open-hole portion of the well bore, a casing packer mounted on the tubing string between the open-hole packer and the well surface for sealingly engaging the cased portion of the well bore and a sand control device connected to the tubing string below the open-hole packer. The assembly may further comprise additional open-hole packers and sand control devices mounted on the tubing string. The tubing string may additionally have a data acquisition instrument mounted to the tubing string.

The open-hole packer and sand control device may be retrievable. The assembly may have one or more tubing disconnects mounted to the tubing string to disconnect segments of the tubing assembly. A tubing disconnect may be mounted to the tubing string between the open-hole packer and the sand control device or between the open-hole packer and the casing packer. The tubing string may further comprise a selective flow device for selectively controlling the flow of well fluids from the well bore into the tubing string. These devices may be controlled from the surface, activated by acoustic telemetry, or by surface intervention, by wireline or coil tubing.

Another aspect of the invention comprises a subterranean well having a well bore with a well surface, the subterranean well comprising a cased portion along at least a length of the well bore, an open-hole portion along at least a length of the well bore below the cased portion, and a tubing string assembly positioned in the well bore, the tubing assembly comprising: a length of tubing extending from the well surface to the open-hole portion of the well bore, a casing packer connected to the tubing for sealingly engaging the cased portion of the well bore, an open-hole packer connected to the tubing for sealingly engaging the open-hole portion of the well bore and a sand control device connected to the tubing.

The method of performing a flow test in a well bore in an unconsolidated subterranean formation, the well bore having a cased portion above an open-hole portion, comprises the steps of running a tubing assembly into the well bore, the tubing assembly comprising tubing, a casing packer mounted thereon, an open-hole packer mounted on the tubing downhole from the casing packer and a sand control device mounted on the tubing downhole from the open-hole packer; setting the casing packer in the cased portion of the well bore; setting the open-hole packer in the open-hole portion of the well bore; and selectively flowing fluids from the unconsolidated formation through the sand control device and into the tubing assembly to conduct the flow test.

The method may further comprise the steps of measuring well data, retrieving at least a segment of the tubing assembly, and disconnecting at least a segment of the tubing assembly. In the method, the tubing assembly may further comprise another open-hole packer mounted on the tubing downhole of the sand control device and another sand control device mounted to the tubing downhole of the another open-hole packer. The step of selectively flowing fluids may include selectively flowing fluids through the multiple sand control devices.

BRIEF DESCRIPTION OF THE DRAWINGS

Drawings of the preferred embodiment of the invention are attached hereto, so that the invention may be better and more fully understood, in which.

Figure 1A:
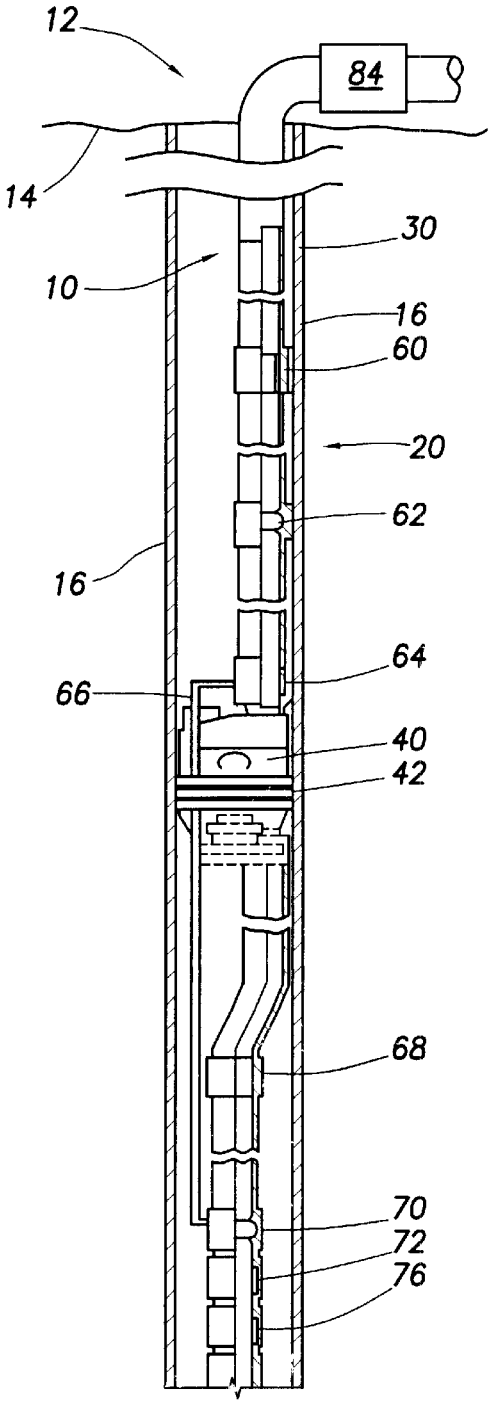
FIGS. 1A and B illustrate the testing apparatus of the present invention.

Numeral references are employed to designate like parts throughout the various figures of the drawing. Terms such as "left," "right," "clockwise," "counter-clockwise," horizontal," "vertical," "up" and "down" when used in reference to the drawings, generally refer to orientation of the parts in the illustrated embodiment and not necessarily during use. The terms used herein are meant only to refer to the relative positions and/or orientations, for convenience, and are not meant to be understood to be in any manner otherwise limiting. Further, dimensions specified herein are intended to provide examples and should not be considered limiting.

DETAILED DESCRIPTION OF THE PREFERRED EMBODIMENTS

Figure 1B:
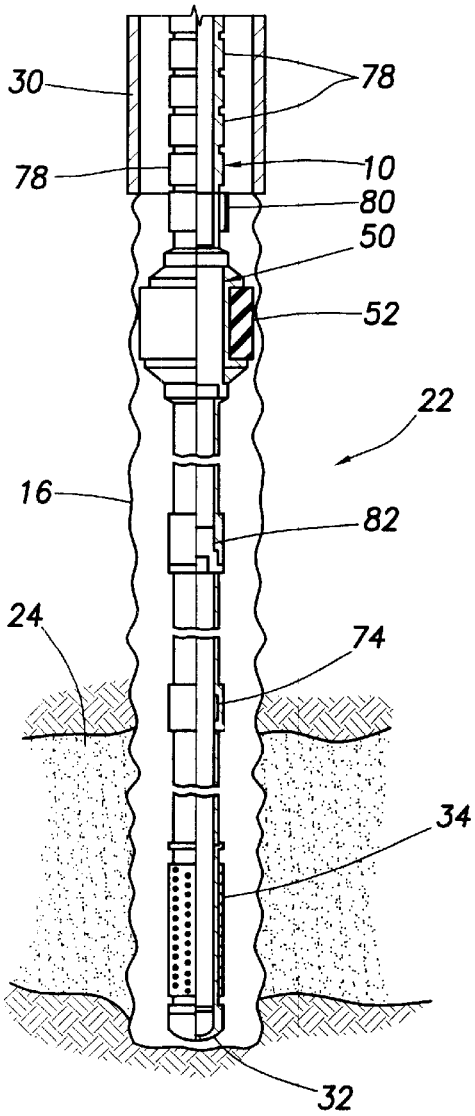

Referring now to FIG. 1, a tubing string 10 is shown for testing the formation characteristics of the subterranean well 12. The well 12 can be on-shore or off-shore. The tubing string 10 extends from the well surface 14 into the well bore 16. The well bore 16 extends from the surface 14 into the subterranean formation 18. The well bore extends through a cased portion 20 and into an un-cased open-hole portion 22 which includes the zone of interest 24 which is to be tested. At least a substantial portion of the formation is unconsolidated, including the zone is of interest 24. The unconsolidated portion of the formation is susceptible to "sloughing" or collapsing into the well bore 16 during drilling or testing operations and is typically formed of sand materials, or a sand-and-shale mixture. The formation is unconsolidated at least if the well bore collapses.

In the cased portion 20 of the well, the well bore 16 is supported by a casing 30. The casing 30 extends over at least a portion of the well bore 16, but does not extend into the open-hole portion 22. The well bore typically is cased, as shown, continuously from the well surface but can also be intermittently cased as circumstances require.

The tubing string 10 extends longitudinally into the well bore and through the cased portion 20. The tubing string carries packers, tester valves, circulating valves and the like to control the flow of fluids through the tubing string. Adjacent the lower end 32 of the tubing string 10 a sand control device 34 is connected. The sand control device 34 can be of many types which are generally known in the art, including one or more sand screens. Preferably PoroPlus sand screens are used and reusable, retrievable screens are preferred.

Mounted on the tubing string 10 are a casing packer 40 and an open-hole packer 50. The packers are shown in their expanded or "set" positions. The packers are run into the hole in a retracted or unexpanded condition. The casing packer 40 has a packer element 42 adapted to sealingly engage the casing 30 of the cased portion 20 of the well. Casing packer 40 is preferably a retrievable direct hydraulic packer with a control line access feature. The casing packer 40 can be of any type generally known in the art and can be an inflatable, compression or other type of packer, and can be actuated hydraulically, by wireline or otherwise.

Also mounted on the tubing string 10 is open-hole packer 50 having a packer element 52 adapted to sealingly engage the open-hole portion 22 of well bore 16. Open-hole packer 50 sealingly engages the borehole above the zone of interest 24. The open-hole packer 50 can be of any kind generally known in the art, such as a "hook-wall" packer, but is preferably a non-rotating inflatable packer. The open-hole packer is also preferably retrievable.

The tubing string, as shown in FIGS. 1A and B, can additionally carry other drill string tools for controlling and measuring fluid flow and well characteristics and for manipulating the tubing string. Illustrated are a rupture-disk circulating valve 60, a multi-position valve 62 for under-balanced drilling operations, a cross-over kit 64 having a control line 66, a ball-catcher subassembly 68, a closure valve 70, data acquisition instruments 72 and 74, a well-fluid sampler 76, collars 78, and tubing release mechanisms or disconnects 80 and 82. These tools are generally known in the art and the tubing assembly can include other well tools as desired.

The closure valve 70 can be pressure activated and preferably includes a metering section to allow the normally closed valve to open after a predetermined time delay after pressure is applied thereto. The closure valve provides a "hard" closure for the purpose of pressure build-up. Well-fluid sampler 76 is preferably a single-phase pressure-versus-temperature quality sampler and can be acoustically, electronically or mechanically triggered.

The data acquisition instrument 72 is preferably an acoustic telemetry system and provides real-time data acquisition of well characteristics such as pressure and temperature. Data acquisition instrument 74 similarly measures well data and can be a recorder, such as the Halliburton HMR. An electronic memory recording fluid resistivity tool, such as manufactured by Sonex or Madden can be substituted. Further, a data acquisition instrument 84, such as a flow meter, can be employed at the surface 14.

Figure 2:
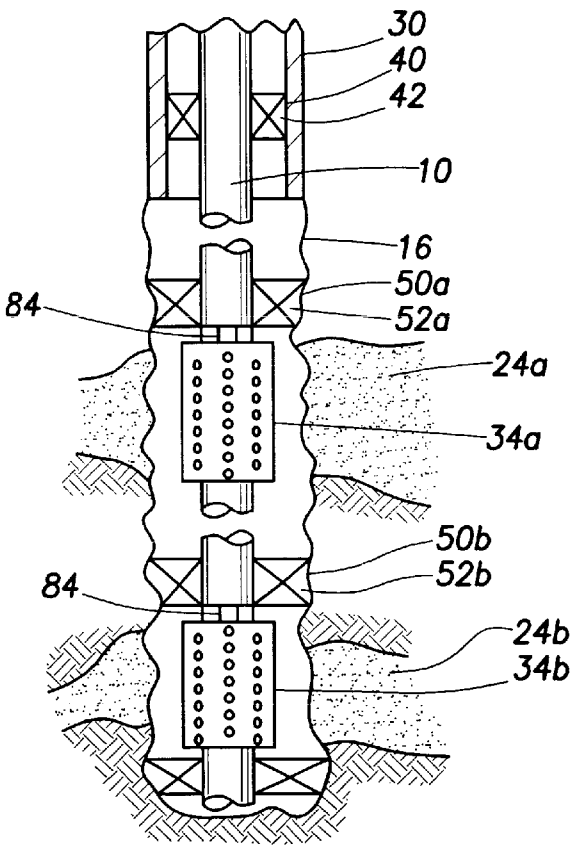
FIG. 2 illustrates another embodiment of the present invention.

Disconnects 80 and 82 allow sections of the tubing string to be released in case the open-hole portion of the well bore collapses and sections of the string cannot be retrieved. Disconnects 80 and 82 are of types generally known in the art and may be mechanically, hydraulically or explosively actuated. Disconnects FIG. 2 shows an alternate embodiment of the invention having multiple open-hole packers and multiple sand control devices. Tubing string 10 includes casing packer 42 for sealingly engaging the casing 30. First and second open-hole packers 50*a* and 50*b*, respectively, with corresponding sealing elements 52*a* and 52*b* engage the well bore 16 in the open-hole portion 22 of the well. A first sand control screen 34*a* is connected to the tubing string 10 below the first open-hole packer 50*a* adjacent a first zone of interest 24*a*. A second sand control screen 34*b* is connected to the tubing string 10 below packer 50*b* adjacent a second zone of interest 24*b*.

A selective flow device 84 is operably connected to the tubing string to selectively control fluid flow through screens 34 for selectively testing the zones of interest. The selective flow device 84 can include internal isolation valves, external screen sleeves or other tools generally known in the art and can operate to provide flow from each zone of interest individually or to provide commingled flow. The tubing string can include any number of screens and open-hole packers to isolate any number of zones of interest.

Figure 3:
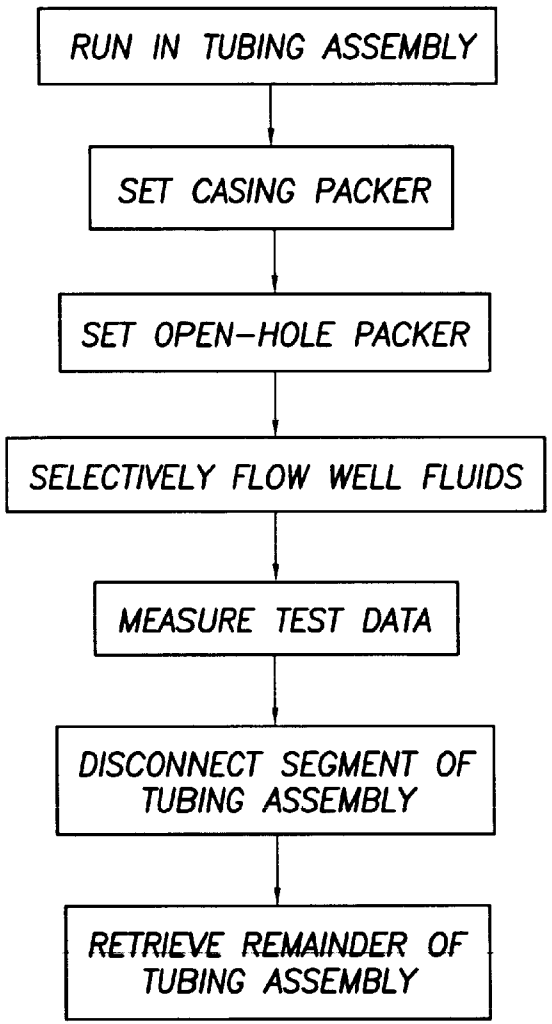
FIG. 3 is a flow-chart to illustrate the method of the invention.

The method of testing an unconsolidated open-hole well is represented in FIG. 3. In practice, the tubing string 10 is run into the well bore 16 which has an open-hole portion 22 below a cased portion 20. The open-hole packer 50 is positioned adjacent the zone of interest 24 to isolate the zone for testing. The casing packer 40 and open-hole packer 50 are activated to sealingly engage the cased portion and open-hole portions of the well, respectively. The packers can be actuated in any order, but the casing packer is preferably set first. If multiple open-hole packers 50*a* and *b*, such as shown in FIG. 2, are employed, each can be activated to isolate multiple zones of interest. Fluid is then selectively flowed into the tubing string through sand control devices, such as sand screen 34. If multiple zones are tested, fluid flow can be selectively flowed from individual zones or flows from multiple zones can be commingled.

After completion of the testing, tubing string 10 is preferably retrieved to the surface. If the well formation collapses, open-hole packer 50 and/or screen 34 may become stuck in the well. If this occurs and the operator is unable to retrieve the entire string 10, screen 34 and/or open-hole packer 50 can be disconnected from the string 10 by activation of disconnects 80 and/or 82. The segment of the string 10 above the activated disconnect can then be retrieved to the surface.

Once the string 10 is at the surface, the sampler 76 and data acquisition instruments 72 and 74 (if retrievable) can be read and the well data analyzed to determine formation characteristics.

It will be seen therefore, that the apparatus and method addressed herein are well-adapted for use in flow testing an unconsolidated well formation. After careful consideration of the specific and exemplary embodiments of the present invention described herein, a person of skill in the art will appreciate that certain modifications, substitutions and other changes may be made without substantially deviating from the principles of the present invention. The detailed description is illustrative, the spirit and scope of the invention being limited only by the appended claims.

Having described the invention, what is claimed is:

1. A tubing assembly for use in testing an unconsolidated open-hole portion of a well bore located below a cased portion of the well bore, the tubing assembly comprising:

an elongated tubing string extending from a well surface into the unconsolidated open-hole portion of the well bore;

a casing packer mounted on the tubing string between the open-hole packer and the well surface, the casing packer for sealingly engaging the cased portion of the well bore; and a sand screen connected to the tubing string below the open-hole packer.

2. An assembly as in claim 1 further comprising at least-one additional open-hole packer mounted on the tubing string below the sand screen.

3. An assembly as in claim 1 additionally comprising an open-hole packer mounted at the lower end of the tubing string.

4. An assembly as in claim 2 additionally comprising another sand screen connected to the tubing string below at least one of the additional open-hole packers.

5. An assembly as in claim 1 further comprising a data acquisition instrument mounted to the tubing string.

6. An assembly as in claim 1 wherein the open-hole packer is retrievable.

7. An assembly as in claim 1 further comprising at least one tubing disconnect mounted to the tubing string.

8. An assembly as in claim 7 wherein at least one tubing disconnect is mounted to the tubing string between the open-hole packer and the sand screen.

9. An assembly as in claim 5 wherein at least one tubing disconnect is mounted to the tubing string between the open-hole packer and the casing packer.

10. An assembly as in claim 1 further comprising a selective flow device mounted to the tubing string for selectively controlling flow of well fluids from the well bore into the tubing string.

11. An assembly as in claim 10 wherein the selective flow device comprises at least one moveable screen.

12. An assembly as in claim 1 wherein the well bore is offshore.

13. An assembly as in claim 4 further comprising a selective flow device mounted to the tubing string for selectively controlling flow of well fluids from the well bore into the tubing string.

14. A subterranean well having a well bore with a well surface, the well comprising:

a cased portion along at least a length of the well bore;

an open-hole portion along at least a length of the well bore below the cased portion; and a tubing string assembly positioned in the well bore, the tubing assembly comprising: a length of tubing extending from the well surface to the open-hole portion of the well bore, a casing packer connected to the tubing for sealingly engaging the cased portion of the well bore, an open-hole packer connected to the tubing for sealingly engaging the open-hole portion of the well bore and an sand screen connected to the tubing.

15. A well as in claim 14 further comprising at lest one additional open-hole packer mounted on the tubing below the sand screen.

16. A well as in claim 14 additionally comprising an open-hole packer mounted at a lower end of the tubing assembly.

17. A well as in claim 15 additionally comprising another sand screen connected to the tubing below at least one of the additional open-hole packers.

18. A well as in claim 14 wherein the open-hole portion of the well bore extends through an unconsolidated formation.

19. A well as in claim 14 wherein the casing packer is sealingly engaged against the cased portion of the well bore.

20. A well as in claim 19 wherein the open-hole packer is sealingly engaged against the open-hole portion of the well bore.

21. A well as in claim 14 wherein the sand screen is downhole of the open-hole packer.

22. A well as in claim 21 wherein the sand screen can be selectively opened to allow fluid flow from the well bore through the sand screen.

23. A well as in claim 14 further comprising a flow meter connected to the tubing assembly.

24. A well as in claim 13 wherein the flow meter is above the well surface.

25. A well as in claim 14 wherein the tubing assembly further comprises a fluid sampler.

26. A well as in claim 21 wherein the tubing string assembly further comprises at least one disconnect mounted on the tubing.

27. A well as in claim 26 wherein at least one disconnect is mounted between the sand screen and the open-hole packer.

28. A well as in claim 27 wherein another disconnect is mounted between the open-hole packer and the casing packer.

29. A well as in claim 14 wherein the tubing string assembly further comprises multiple open-hole packers.

30. A method of performing a flow test in a well bore in an unconsolidated subterranean formation, the well bore having a cased portion above an open-hole portion, the method comprising the steps of:

running a tubing assembly into the well bore, the tubing assembly comprising tubing, a casing packer mounted thereon, an open-hole packer mounted on the tubing downhole from the casing packer and a sand screen mounted on the tubing downhole from the open-hole packer;

setting the casing packer in the cased portion of the well bore;

setting the open-hole packer in the open-hole portion of the well bore; and selectively flowing fluids from the unconsolidated formation through the sand screen and into the tubing assembly to conduct the flow test.

31. A method as in 30 further comprising the step of measuring well data.

32. A method as in 30 further comprising the step of retrieving at least a segment of the tubing assembly.

33. A method as in 32 wherein at least the casing packer is retrieved.

34. A method as in 32 further comprising the step of disconnecting at least a segment of the tubing assembly.

35. A method as 34 wherein the sand screen is disconnected from the tubing assembly.

36. A method as in 30 wherein the tubing assembly further comprises another open-hole packer mounted on the tubing downhole of the sand screen; and comprising the further step of setting the second open-hole packer in the open-hole portion of the well bore.

37. A method as in 36 wherein the tubing assembly further comprises another sand screen mounted to the tubing downhole of the another open-hole packer.

38. A method as in 30 wherein the tubing assembly comprises multiple open-hole packers and multiple sand screens mounted to the tubing.

39. A method as in 38 wherein the step of selectively flowing fluids further includes selectively flowing fluids through the multiple sand screens.

* * * * *